US008368733B2

(12) United States Patent
Koroishi et al.

(10) Patent No.: US 8,368,733 B2
(45) Date of Patent: Feb. 5, 2013

(54) THERMAL HEAD AND PRINTER

(75) Inventors: Keitaro Koroishi, Chiba (JP); Toshimitsu Morooka, Chiba (JP); Noriyoshi Shoji, Chiba (JP); Norimitsu Sanbongi, Chiba (JP)

(73) Assignee: Seiko Instruments Inc. (JP)

( * ) Notice: Subject to any disclaimer, the term of this patent is extended or adjusted under 35 U.S.C. 154(b) by 110 days.

(21) Appl. No.: 12/928,260

(22) Filed: Dec. 7, 2010

(65) Prior Publication Data

US 2011/0149008 A1 Jun. 23, 2011

(30) Foreign Application Priority Data

Dec. 17, 2009 (JP) ..... 2009-286771

(51) Int. Cl.
*B41J 2/335* (2006.01)

(52) U.S. Cl. ..... 347/202

(58) Field of Classification Search ..... 347/200, 347/202, 205

See application file for complete search history.

(56) References Cited

U.S. PATENT DOCUMENTS

| | | | | |
|---|---|---|---|---|
| 7,768,541 | B2 * | 8/2010 | Koroishi et al. | 347/202 |
| 8,111,273 | B2 * | 2/2012 | Morooka et al. | 347/204 |
| 8,144,175 | B2 * | 3/2012 | Koroishi et al. | 347/200 |
| 8,154,575 | B2 * | 4/2012 | Koroishi et al. | 347/207 |
| 8,169,452 | B2 * | 5/2012 | Morooka et al. | 347/206 |
| 2009/0231408 | A1 | 9/2009 | Shoji et al. | 347/206 |

FOREIGN PATENT DOCUMENTS

| | | | |
|---|---|---|---|
| EP | 2056648 | | 5/2009 |
| JP | 60006478 | | 1/1985 |
| JP | 2008-200913 | * | 9/2008 |

OTHER PUBLICATIONS

Computer-generated translation of JP 2008-200913, published on Sep. 2008.*

* cited by examiner

*Primary Examiner* — Huan Tran
(74) *Attorney, Agent, or Firm* — Adams & Wilks

(57) ABSTRACT

A thermal head includes a substrate main body including a flat plate-shaped support substrate and a flat plate-shaped upper substrate which are bonded to each other in a stacked state. A rectangular heating resistor is formed on a surface of the flat plate-shaped upper substrate. A bonding surface of the flat plate-shaped support substrate includes a concave portion that forms a cavity portion in a region opposed to the rectangular heating resistor and the concave portion includes a groove formed in an inner wall thereof and recessed along a depth direction of the concave portion within a range of a width of the rectangular heating resistor. The thermal head is capable of enhancing heat-insulating performance while maintaining mechanical strength of the upper substrate.

9 Claims, 10 Drawing Sheets

THERMAL HEAD AND PRINTER

BACKGROUND OF THE INVENTION

1. Field of the Invention

The present invention relates to a thermal head and a printer.

2. Description of the Related Art

There has been conventionally known a thermal head for use in thermal printers that are often installed in compact information equipment terminals typified by a compact hand-held terminal, which performs printing on a thermal recording medium by selectively supplying a plurality of heating resistors with current based on printing data (see, for example, Japanese Patent Application Laid-open No. 2007-83532).

For increasing efficiency of the thermal head, there is a method involving forming a cavity portion in a substrate supporting the heating resistors. The cavity portion functions as a hollow heat-insulating layer. Accordingly, among an amount of heat generated by the heating resistors, an amount of heat transferring toward the substrate may be reduced to increase an amount of heat transferring to an opposite side of the heating resistors with respect to the substrate, to thereby increase energy efficiency required for printing.

The thermal head described in Japanese Patent Application Laid-open No. 2007-83532 has a structure in which one of an upper substrate (heat storage layer) and a support substrate, which are made of the same material such as glass, has a concave portion formed therein, and the upper substrate and the support substrate are bonded together so that the concave portion is closed to form a cavity portion inside the bonded substrates. The cavity portion may have any shape, the size of which may be larger or smaller than the size of the heating resistors as long as the size is close to that of the heating resistors when viewed from a stacking direction of the substrates.

However, if the size of the cavity portion is larger than an effective heating area of the heating resistors, there is an inconvenience that mechanical strength of the upper substrate may reduce, though heat-insulating performance between the heating resistors and the substrate may be enhanced. On the other hand, if the size of the cavity portion is smaller than the effective heating area of the heating resistors, there is an inconvenience that the heat-insulating performance may reduce, though the mechanical strength of the upper substrate may be increased.

SUMMARY OF THE INVENTION

The present invention has been made in view of the above-mentioned circumstances, and it is an object of the present invention to provide a thermal head capable of enhancing heat-insulating performance while maintaining mechanical strength of an upper substrate, and to provide a printer including the thermal head.

In order to achieve the above-mentioned object, the present invention provides the following measures.

The present invention provides a thermal head including: a substrate including a flat plate-shaped support substrate and a flat plate-shaped upper substrate which are bonded to each other in a stacked state; and a rectangular heating resistor formed on a surface of the flat plate-shaped upper substrate, in which: at least one of bonding surfaces of the flat plate-shaped support substrate and the flat plate-shaped upper substrate includes a concave portion that forms a cavity portion in a region opposed to the rectangular heating resistor; and the concave portion includes at least one groove portion formed in an inner wall thereof and recessed along a depth direction of the concave portion within a range of a width of the rectangular heating resistor.

According to the present invention, the upper substrate disposed directly under the heating resistor functions as a heat storage layer, whereas the cavity portion formed in the substrate in the region opposed to the heating resistor functions as a hollow heat-insulating layer. Because of the formation of the cavity portion, among an amount of heat generated by the heating resistor, an amount of heat transferring toward the support substrate via the upper substrate may be reduced to increase an amount of heat transferring to an opposite side of the heating resistor with respect to the support substrate to be utilized for printing and the like, to thereby increase heating efficiency.

Here, in the inner wall of the concave portion forming the cavity portion, the groove portion is provided within the range of the width of the heating resistor. Therefore, the inner wall of the concave portion contributes to securing partial support of the upper substrate covering the cavity portion, while the groove portion of the inner wall contributes to extending in part a space serving as the hollow heat-insulating layer formed under the heating resistor. As a result, the heat-insulating performance against the heat transfer from the heating resistor toward the support substrate may be enhanced while maintaining the mechanical strength of the upper substrate supporting the heating resistor.

In the above-mentioned invention, the inner wall including the at least one groove portion of the concave portion may be positioned inside a heating region of the rectangular heating resistor, or alternatively may be positioned outside the region opposed to the rectangular heating resistor.

With such a structure, the heat-insulating performance may be enhanced compared with a case where the inner wall of the concave portion has a flat shape.

Further, in the above-mentioned invention, the inner wall of the concave portion may be positioned inside a heating region of the rectangular heating resistor, and the at least one groove portion may be positioned inside the region opposed to the rectangular heating resistor and outside the heating region of the rectangular heating resistor.

With such a structure, a heat-insulating effect due to the groove portion of the inner wall may be enhanced while maintaining the mechanical strength of the upper substrate by the inner wall of the concave portion.

Still further, in the above-mentioned invention, the inner wall including the at least one groove portion of the concave portion may be positioned inside the region opposed to the rectangular heating resistor and outside a heating region of the rectangular heating resistor.

With such a structure, the outside of the heating region of the heating resistor may be securely supported by the upper substrate and the support substrate to reduce the load on the upper substrate supporting the heating resistor, and the sufficient heat-insulating effect against the heat transfer from the heating resistor toward the support substrate may be ensured because the cavity portion is disposed directly under the heating region of the heating resistor.

Still further, in the above-mentioned invention, the inner wall of the concave portion may be positioned inside a heating region of the rectangular heating resistor, and the at least one groove portion may be positioned outside the region opposed to the rectangular heating resistor.

With such a structure, the inner wall of the concave portion may contribute to the increased mechanical strength of the upper substrate, while the groove portion of the inner wall may contribute to the enhanced heat-insulating performance against the heat transfer from the heating resistor toward the support substrate.

Still further, in the above-mentioned invention, the at least one groove portion may be recessed to depths varying in steps, or alternatively the groove portions may form the inner wall of the concave portion into a shape in which projections and depressions are alternately formed continuously.

The shape of the inner wall of the concave portion varies regularly, which makes it easy to adjust the balance between maintaining the mechanical strength of the upper substrate and enhancing the heat-insulating performance.

The present invention also provides a printer including: the above-mentioned thermal head according to the present invention; and a pressure mechanism for feeding a thermal recording medium while pressing the thermal recording medium against the rectangular heating resistor of the thermal head.

According to the present invention, the thermal head capable of enhancing the heat-insulating performance while maintaining the mechanical strength is used, and hence the heat generated by the heating resistor may be transferred with high efficiency to the thermal recording medium that is pressed against the heating resistor by the pressure mechanism. Besides, because of the thermal head having high heating efficiency, power consumption during printing on the thermal recording medium may be reduced.

The present invention provides an effect of enhancing the heat-insulating performance while maintaining the mechanical strength of the upper substrate.

DETAILED DESCRIPTION OF THE PREFERRED EMBODIMENT

Now, a thermal head and a thermal printer (printer) according to an embodiment of the present invention are described below with reference to the accompanying drawings.

Figure 1:
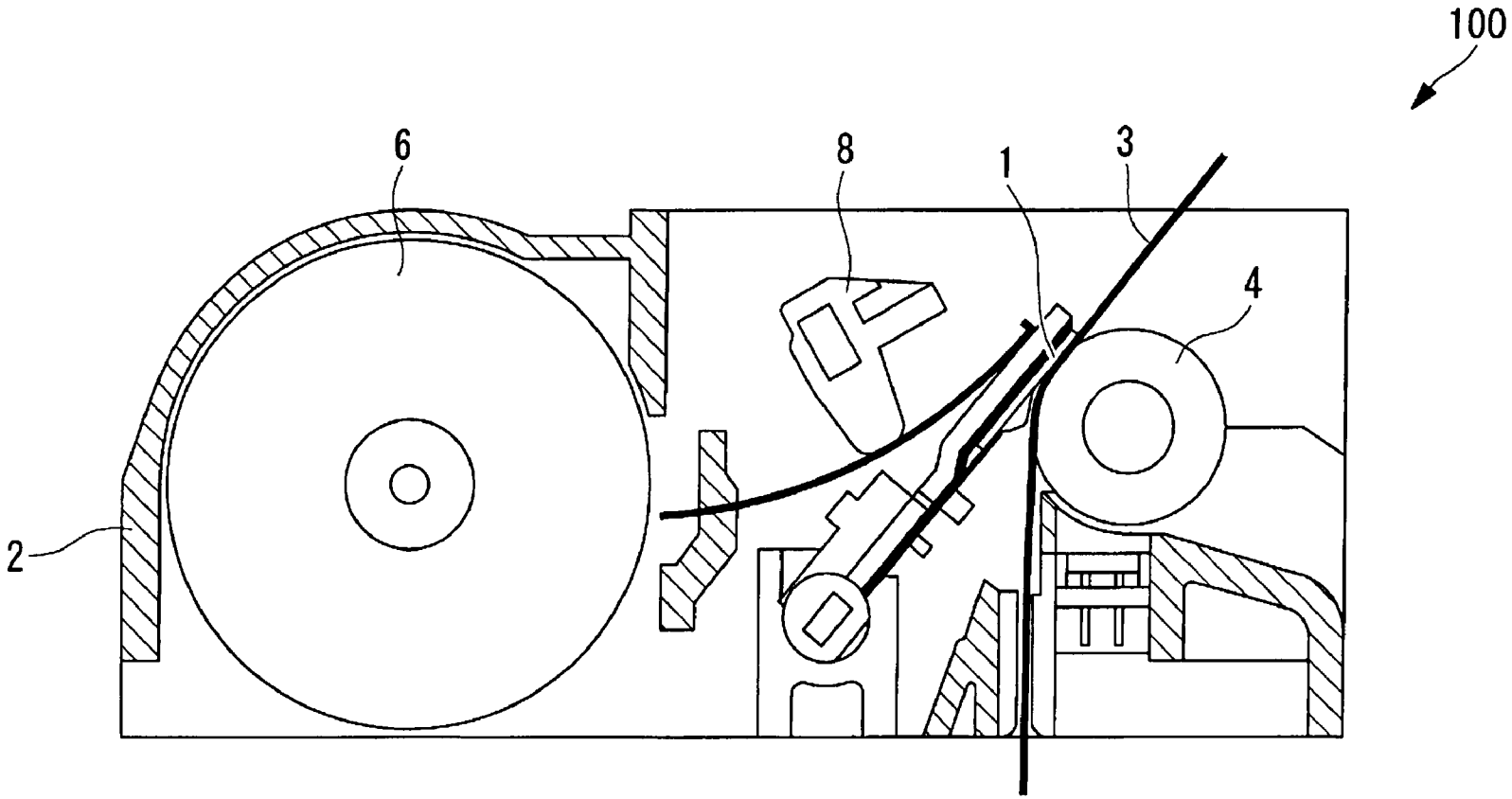
FIG. 1 is a schematic structural view of a thermal printer according to an embodiment of the present invention.

A thermal head 1 according to this embodiment is used for, for example, a thermal printer 100 as illustrated in FIG. 1. The thermal printer 100 includes a main body frame 2, a platen roller 4 disposed horizontally, the thermal head 1 disposed so as to be opposed to an outer peripheral surface of the platen roller 4, a paper feeding mechanism 6 for feeding an object to be printed, such as thermal paper 3, between the platen roller 4 and the thermal head 1, and a pressure mechanism 8 for pressing the thermal head 1 against the thermal paper 3 with a predetermined pressing force.

Against the platen roller 4, the thermal head 1 and the thermal paper 3 are pressed by the operation of the pressure mechanism 8. Accordingly, a load of the platen roller 4 is applied to the thermal head 1 via the thermal paper 3.

Figure 2:
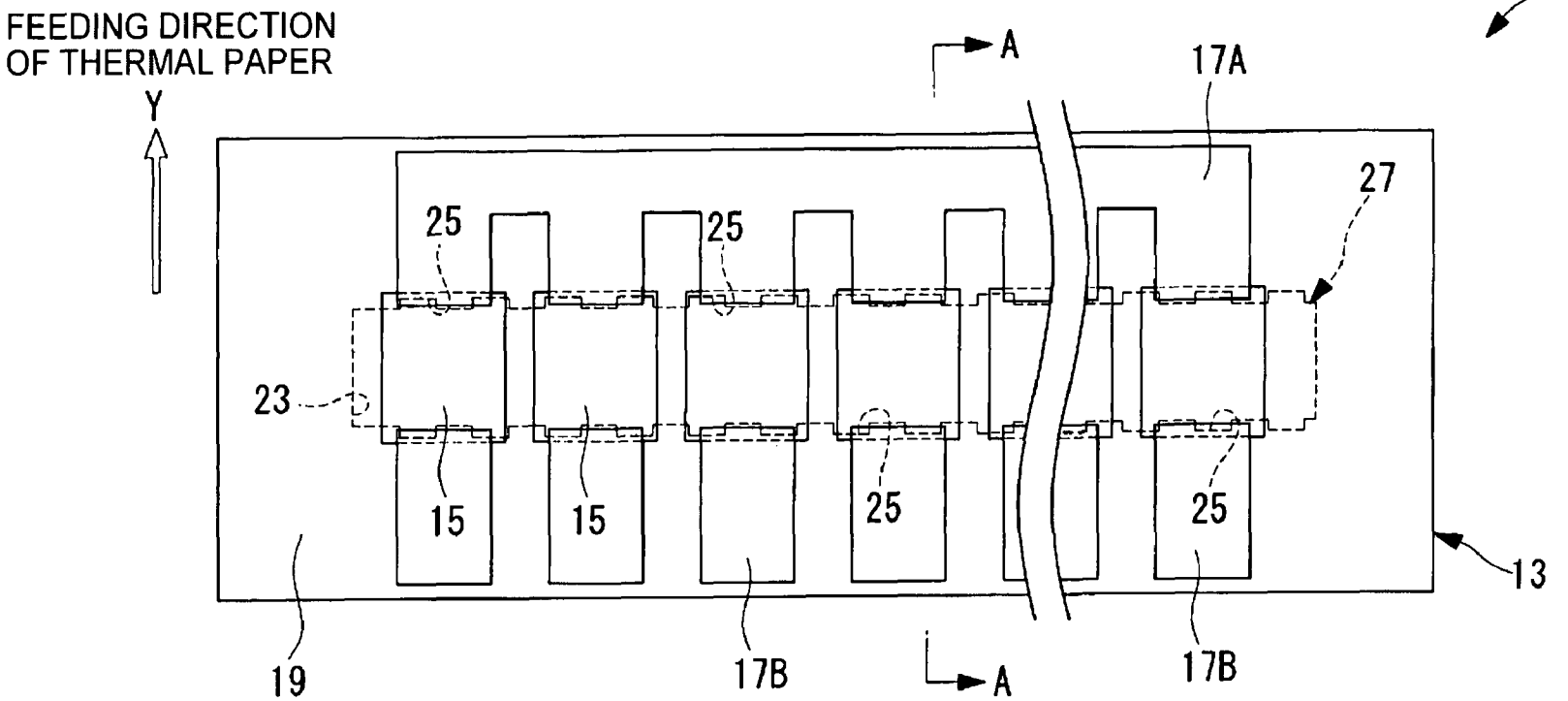
FIG. 2 is a plan view of a thermal head of FIG. 1 viewed from a protective film side.
Figure 3:
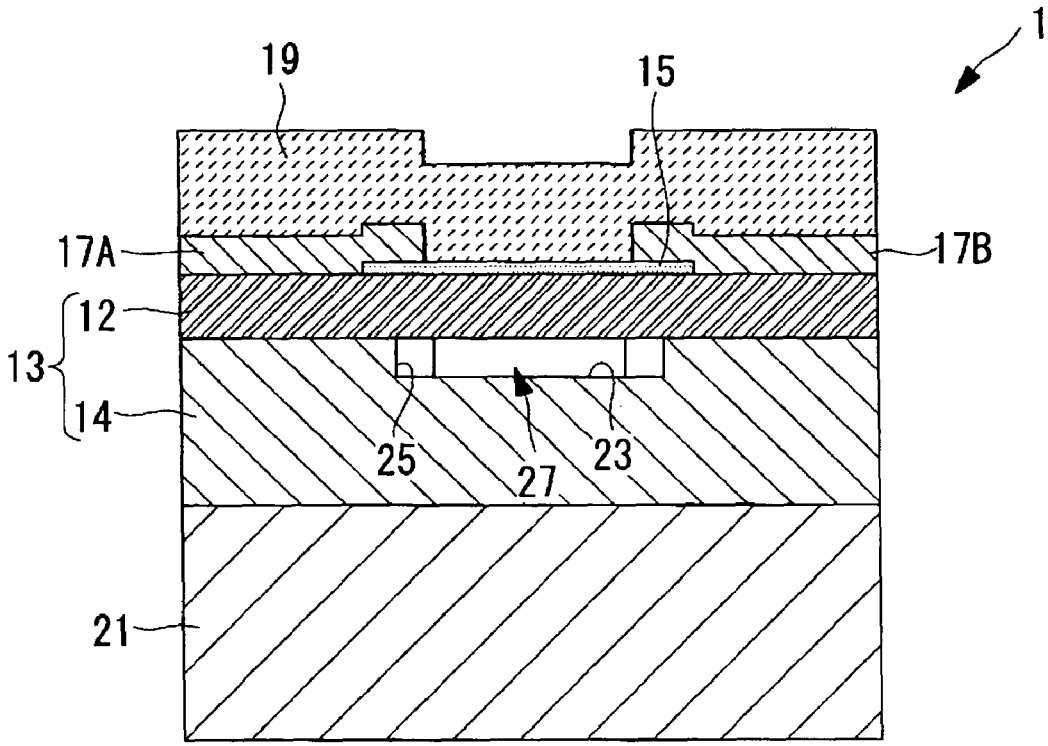
FIG. 3 is a cross-sectional view taken along the line A-A of the thermal head of FIG. 2.

As illustrated in FIGS. 2 and 3, the thermal head 1 includes a flat plate-shaped substrate main body (substrate) 13, a plurality of flat plate-shaped heating resistors 15 provided on the substrate main body 13, pairs of electrode portions 17A and 17B connected to both ends of the heating resistors 15 on the substrate main body 13, and a protective film 19 covering the heating resistors 15 and the electrode portions 17A and 17B on the substrate main body 13. In FIG. 2, the arrow Y represents a feeding direction of the thermal paper 3 by the platen roller 4 (the same holds true for FIGS. 4, 10, 11, and 12).

The substrate main body 13 is fixed to a heat dissipation plate 21 as a plate-shaped member made of a metal such as aluminum, a resin, ceramics, glass, or the like, to thereby dissipate heat via the heat dissipation plate 21. The substrate main body 13 includes a flat plate-shaped upper substrate 12 and a flat plate-shaped support substrate 14 which are bonded in a stacked state. The upper substrate 12 has the heating resistors 15 formed thereon, and the support substrate 14 supports the upper substrate 12 and is fixed to the heat dissipation plate 21.

The upper substrate 12 is a glass substrate with a thickness approximately ranging from 10 μm to 100 μm. The upper substrate 12 is disposed directly under the heating resistors 15 to function as a heat storage layer for storing a part of heat generated from the heating resistors 15.

The support substrate 14 is, for example, an insulating substrate such as a glass substrate or a ceramic substrate having a thickness approximately ranging from 300 μm to 1 mm. For the upper substrate 12 and the support substrate 14, it is desired to use glass substrates made of the same material or substrates having similar properties.

The support substrate 14 has a concave portion 23 formed therein to be recessed in a thickness direction from a bonding surface to the upper substrate 12. The concave portion 23 is formed in a rectangular shape extending in a longitudinal direction of the support substrate 14, and is disposed so as to be opposed to all the heating resistors 15 on the upper substrate 12.

Each inner wall extending in a longitudinal direction of the concave portion 23 has a plurality of grooves (groove portions) 25 formed therein, which are recessed along a depth direction from an opening portion to a bottom surface of the concave portion 23. The grooves 25 are arrayed at predetermined intervals in the longitudinal direction of the concave portion 23 such that at least one groove 25 is present within a range of each width of the heating resistors 15. In other words, the inner wall extending in the longitudinal direction of the concave portion 23 has a shape with projections and depressions defined by the grooves 25.

The inner walls of the concave portion 23 have a width dimension smaller than a dimension between the electrode portions 17A and 17B connected to both the ends of the heating resistors 15. The groove 25 of the inner wall has a width dimension smaller than a dimension of the heating resistor 15 in a longitudinal direction thereof, which is orthogonal to a width direction (array direction of the heating resistors 15).

The concave portion 23 is formed in a given surface of the support substrate 14 by performing, for example, sandblasting, dry etching, wet etching, or laser machining.

In the case of forming the concave portion 23 by sandblasting, the surface of the support substrate 14 is first covered with a photoresist material, and then the photoresist material is exposed to light using a photomask of a predetermined pattern so as to be cured in part other than the region for forming the concave portion 23.

After that, the surface of the support substrate 14 is cleaned and the uncured photoresist material is removed to obtain an etching mask (not shown) having an etching window formed in the region for forming the concave portion 23. In this state, sandblasting is performed on the surface of the support substrate 14 to form the concave portion 23 having a predetermined depth. Note that, it is preferred that the depth of the concave portion 23 be, for example, 10 μm or more and half the thickness of the support substrate 14 or less.

Alternatively, in the case of forming the concave portion 23 by dry etching or wet etching, similarly to the above-mentioned processing by sandblasting, the etching mask having the etching window formed in the region for forming the concave portion 23 is formed on the surface of the support substrate 14. In this state, etching is performed on the surface of the support substrate 14 to form the concave portion 23 having a predetermined depth. In the case of wet etching, the surface of the support substrate 14 may be flawed in advance so that etching may progress with priority.

As such an etching process, for example, wet etching using a hydrofluoric acid-based etchant or the like is available, as well as dry etching such as reactive ion etching (RIE) and plasma etching. Note that, as a reference example, in a case of a single-crystal silicon support substrate, wet etching may be performed using an etchant such as a tetramethylammonium hydroxide solution, a KOH solution, or a mixed solution of hydrofluoric acid and nitric acid.

Still alternatively, in the case of forming the concave portion 23 by laser machining, scanning is performed using a light beam while varying its beam intensity, to form the concave portion 23 having a desired shape.

In forming the concave portion 23 using such a processing method, the employed processing method may also be used to form a desired number of grooves 25 with a desired shape and width dimension in the inner wall.

The upper substrate 12 is stacked on the support substrate 14 in which the concave portion 23 is thus formed, to thereby close the opening portion of the concave portion 23 to form a cavity portion 27 between the upper substrate 12 and the support substrate 14. The cavity portion 27 has a communication structure opposed to all the heating resistors 15, and functions as a hollow heat-insulating layer for preventing the heat generated by the heating resistors 15 from transferring toward the support substrate 14 via the upper substrate 12.

The heating resistors 15 are each formed on a surface of the upper substrate 12 so as to straddle the cavity portion 27 in its width direction, and are arrayed at predetermined intervals along a longitudinal direction of the cavity portion 27. The heating resistors 15 each have a heating region which is situated between the electrode portions 17A and 17B connected to both the ends in the longitudinal direction and substantially directly above the cavity portion 27.

The electrode portions 17A and 17B supply the heating resistors 15 with power to allow the heating resistors 15 to generate heat. The electrode portions 17A and 17B include a common electrode 17A connected to one end of each of the heating resistors 15 in the longitudinal direction, and a plurality of individual electrodes 17B connected to another end of each of the heating resistors 15. The common electrode 17A is integrally connected to all the heating resistors 15, and the individual electrodes 17B are connected to the heating resistors 15 individually.

Hereinafter, an action of the thermal head 1 and the thermal printer 100 structured in this way is described.

In printing on the thermal paper 3 using the thermal printer 100 according to this embodiment, first, a voltage is selectively applied to the individual electrodes 17B of the thermal head 1. Then, a current flows through the heating resistors 15 which are connected to the selected individual electrodes 17B and the common electrode 17A opposed thereto, to thereby allow the heating resistors 15 to generate heat.

Subsequently, the pressure mechanism 8 operates to press the thermal head 1 against the thermal paper 3 being fed by the platen roller 4. The platen roller 4 rotates about an axis parallel to the array direction of the heating resistors 15, to thereby feed the thermal paper 3 toward the Y direction orthogonal to the array direction of the heating resistors 15. Against the thermal paper 3, a surface portion (printing portion) of the protective film 19 covering the heating regions of the heating resistors 15 is pressed, and then color is developed on the thermal paper 3 to be printed.

Here, because the cavity portion 27 is formed in the substrate main body 13 of the thermal head 1, among an amount of heat generated by the heating resistors 15, an amount of heat transferring toward the support substrate 14 via the upper substrate 12 may be reduced to increase an amount of heat transferring from the heating resistors 15 toward the protective film 19 to be utilized for printing and the like. As a result, heating efficiency of the thermal head 1 may be increased.

In this case, the plurality of grooves 25 are formed in the inner walls of the concave portion 23 constituting the cavity portion 27, and hence a space serving as the hollow heat-insulating layer formed under the heating resistors 15 may be extended in part beyond the heating regions, to thereby reduce an amount of heat directly transferring from the heating regions to the upper substrate 12. Besides, the inner walls of the concave portion 23 contribute to securing partial support of the upper substrate 12 covering the cavity portion 27, to thereby prevent reduction in strength of the upper substrate 12 against an external load.

Therefore, according to the thermal head 1 and the thermal printer 100 of this embodiment, heat-insulating performance against the heat transfer from the heating resistors 15 toward the support substrate 14 may be enhanced while maintaining mechanical strength of the upper substrate 12 supporting the heating resistors 15. As a result, the heat generated by the heating resistors 15 may transfer to the thermal paper 3 with high efficiency, and power consumption during printing on the thermal paper 3 may be reduced.

Figure 4:
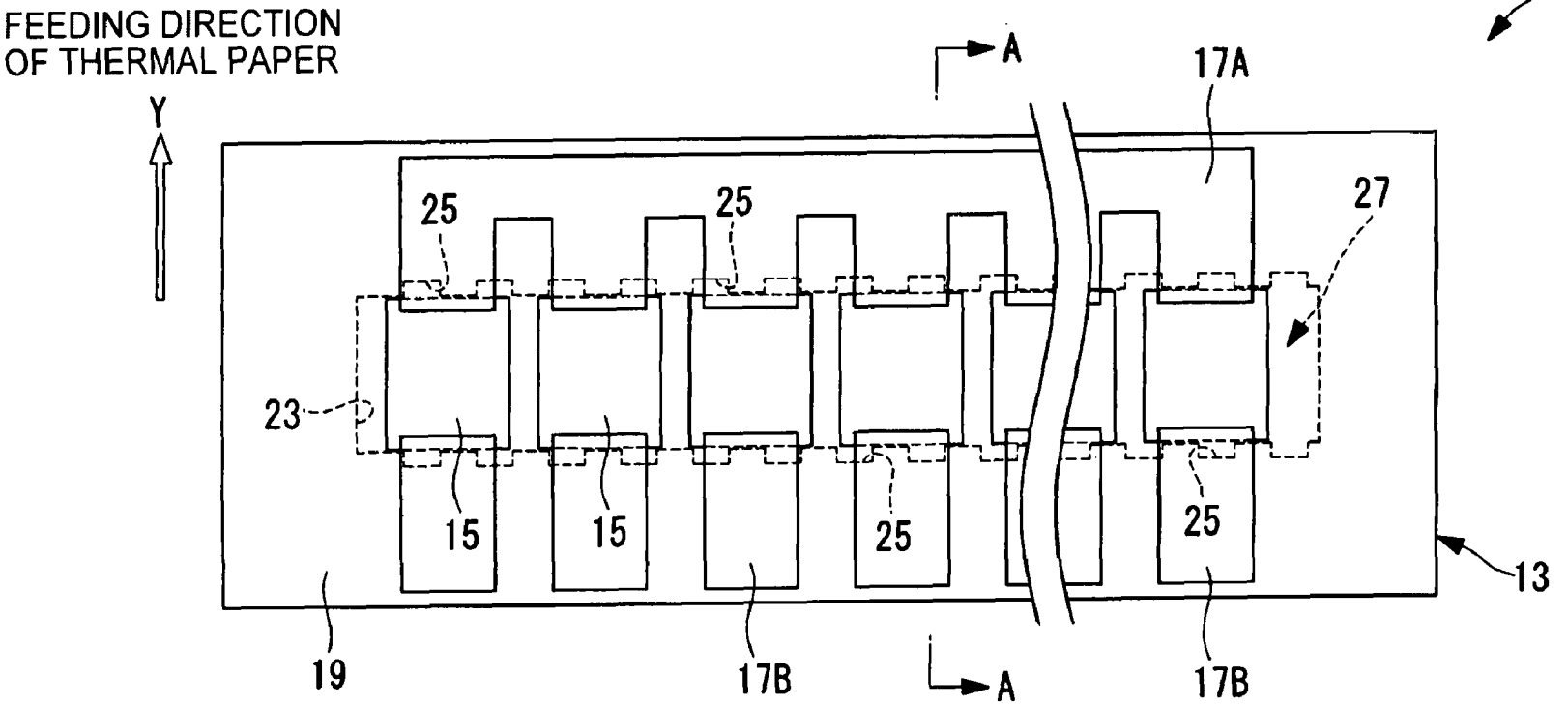
FIG. 4 is a plan view of the thermal head viewed from the protective film side according to the embodiment of the present invention, illustrating a case where a shape of a concave portion is large.

Note that, in this embodiment, the width dimension of the inner walls including the grooves 25, extending in the longitudinal direction of the concave portion 23, is smaller than the dimension of the heating resistor 15 in the longitudinal direction thereof. However, for example, as illustrated in FIG. 4, the width dimension of the inner walls including the grooves 25, extending in the longitudinal direction of the concave portion 23, may be larger than the dimension of the heating resistor 15 in the longitudinal direction thereof. In other words, the inner wall including the grooves 25, extending in the longitudinal direction of the concave portion 23, may be positioned outside the regions opposed to the heating resistors 15. Alternatively, although not illustrated, for example, the width dimension of the inner walls including the grooves 25, extending in the longitudinal direction of the concave portion 23, may be smaller than the dimension of the heating resistors 15 between the electrode portions 17A and 17B. In other words, the inner wall including the grooves 25, extending in the longitudinal direction of the concave portion 23, may be positioned inside the heating regions of the heating resistors 15.

In such a way, the heat-insulating performance may be enhanced compared with a case where the inner wall of the concave portion 23 has a flat shape.

Figure 5:
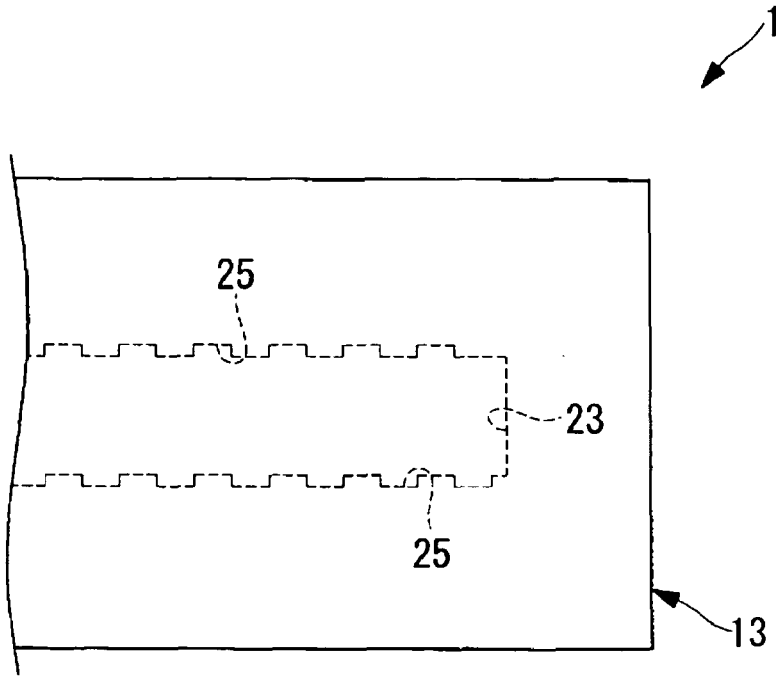
FIG. 5 is a view illustrating a modified example of a groove portion of the thermal head according to the embodiment of the present invention.
Figure 6:
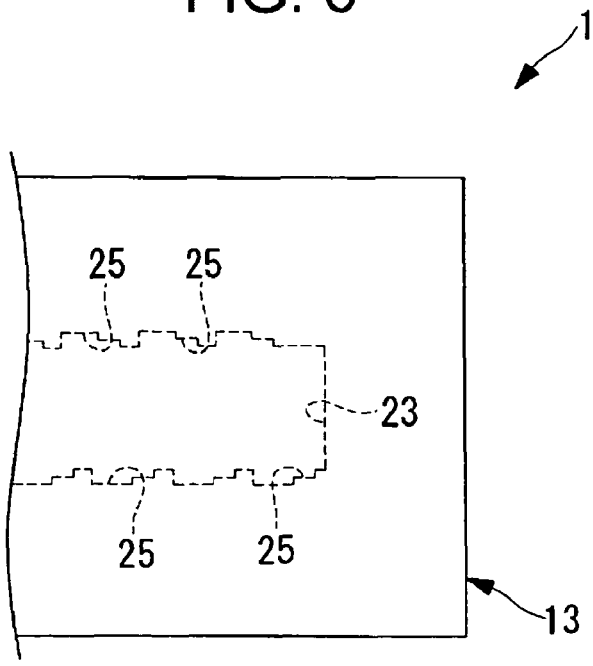
FIG. 6 is a view illustrating another modified example of the groove portion of the thermal head according to the embodiment of the present invention.
Figure 7:
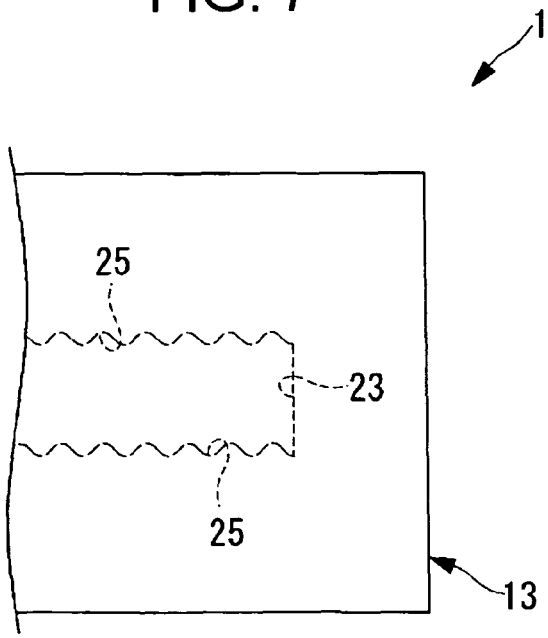
FIG. 7 is a view illustrating a further modified example of the groove portion of the thermal head according to the embodiment of the present invention.
Figure 8:
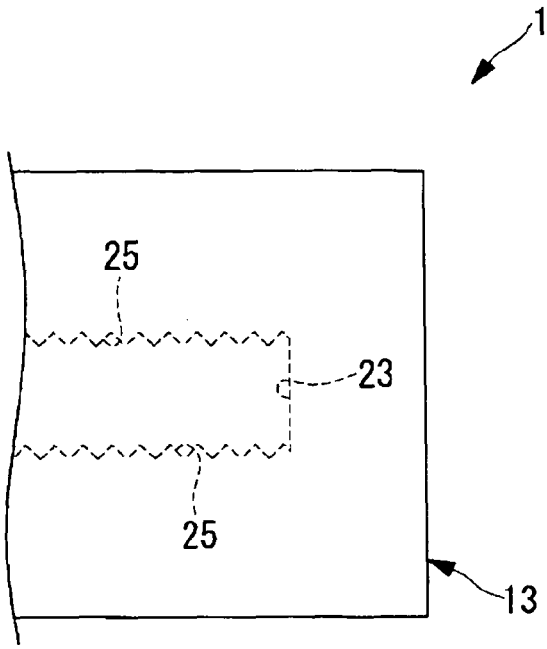
FIG. 8 is a view illustrating a still further modified example of the groove portion of the thermal head according to the embodiment of the present invention.
Figure 9:
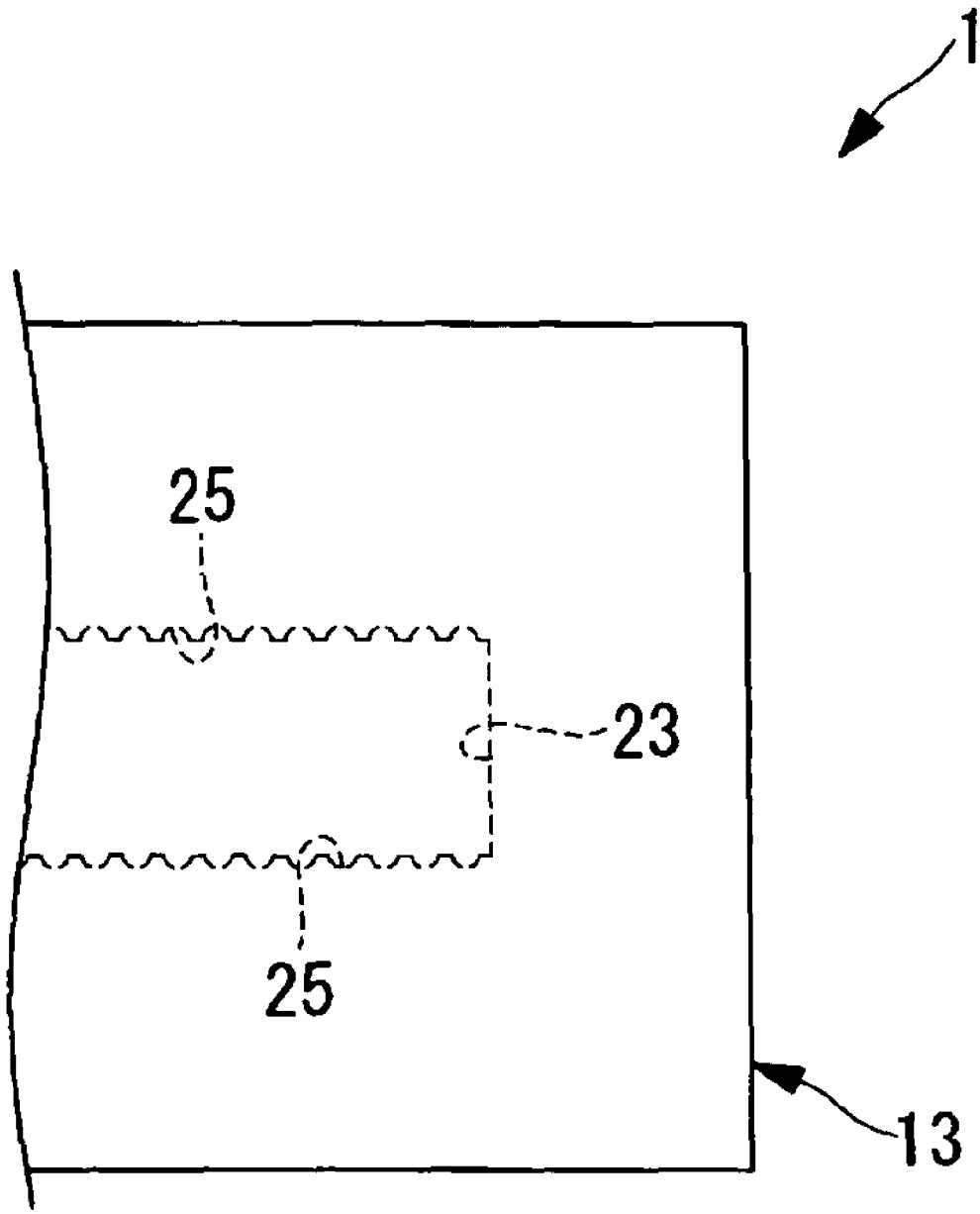
FIG. 9 is a view illustrating a yet further modified example of the groove portion of the thermal head according to the embodiment of the present invention.

In this embodiment, in both the inner walls extending in the longitudinal direction of the concave portion 23, the plurality of grooves 25 are arranged as facing each other. However, for example, as illustrated in FIG. 5, the plurality of grooves 25 may be arranged at alternate positions in both the inner walls. Alternatively, for example, as illustrated in FIG. 6, the groove 25 may be recessed to depths varying in steps. Still alternatively, the inner wall may be formed into a shape in which projections and depressions are alternately formed continuously. For example, the inner wall may have a shape in which the grooves 25 are recessed into a wave shape as illustrated in FIG. 7 or in which the grooves 25 are recessed into a V-shape as illustrated in FIG. 8. Alternatively, as illustrated in FIG. 9, the inner wall may have a shape in which the grooves 25 are recessed into a semi-cylindrical shape. Note that, FIGS. 5 to 9 are views of the substrate main body 13 viewed in a thickness direction.

The grooves 25 of the inner wall have a regular shape as described above, which makes it easy to adjust the balance between maintaining the mechanical strength of the upper substrate 12 and enhancing the heat-insulating performance. Note that, the grooves 25 may be formed in an inner wall extending in a width direction of the concave portion 23, aside from the inner wall extending in the longitudinal direction of the concave portion 23.

Further, the embodiment of the present invention may be modified as follows.

Figure 10:
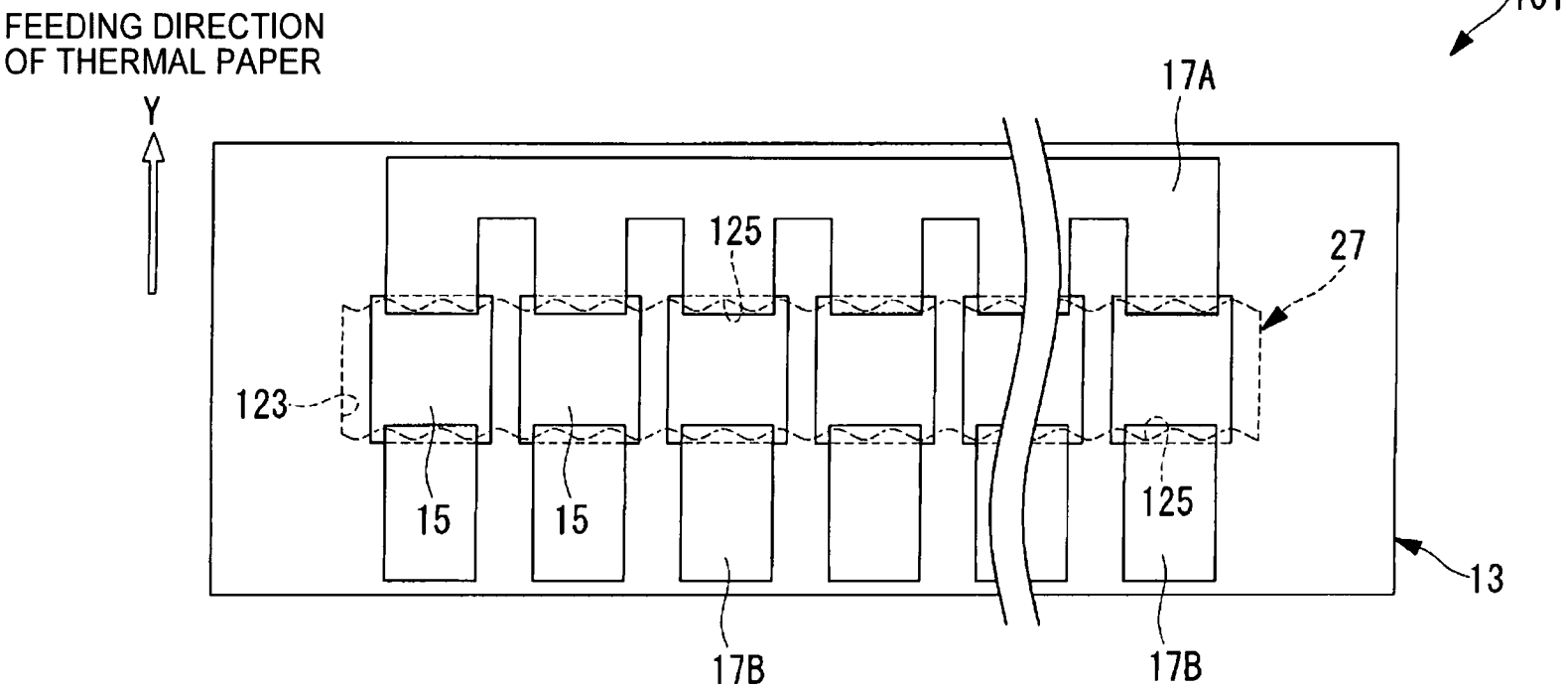
FIG. 10 is a plan view of a thermal head viewed from the protective film side according to a first modified example of the embodiment of the present invention.

For example, in the embodiment of the present invention, the inner wall extending in the longitudinal direction of the concave portion 23 of the thermal head 1 has the width dimension smaller than that of the heating regions of the heating resistors 15, and the groove 25 of the inner wall has the width dimension not exceeding the dimension of the heating resistor 15 in the longitudinal direction thereof. However, according to a thermal head 101 of a first modified example of the embodiment of the present invention, for example, as illustrated in FIG. 10, an inner wall including grooves 125, extending in a longitudinal direction of a concave portion 123, may have a width dimension, as a whole, smaller than the dimension of the heating resistors 15 in the longitudinal direction thereof and larger than that of the heating regions of the heating resistors 15.

With such a structure, the inner wall extending in the longitudinal direction of the concave portion 123 is positioned inside the regions opposed to the heating resistors 15 and outside the heating regions of the heating resistors 15 so that the portion outside the heating regions of the heating resistors 15 is securely supported by the upper substrate 12 and the support substrate 14, while the cavity portion 27 is disposed directly under the heating regions of the heating resistors 15 so that the sufficient heat-insulating effect is ensured.

Figure 11:
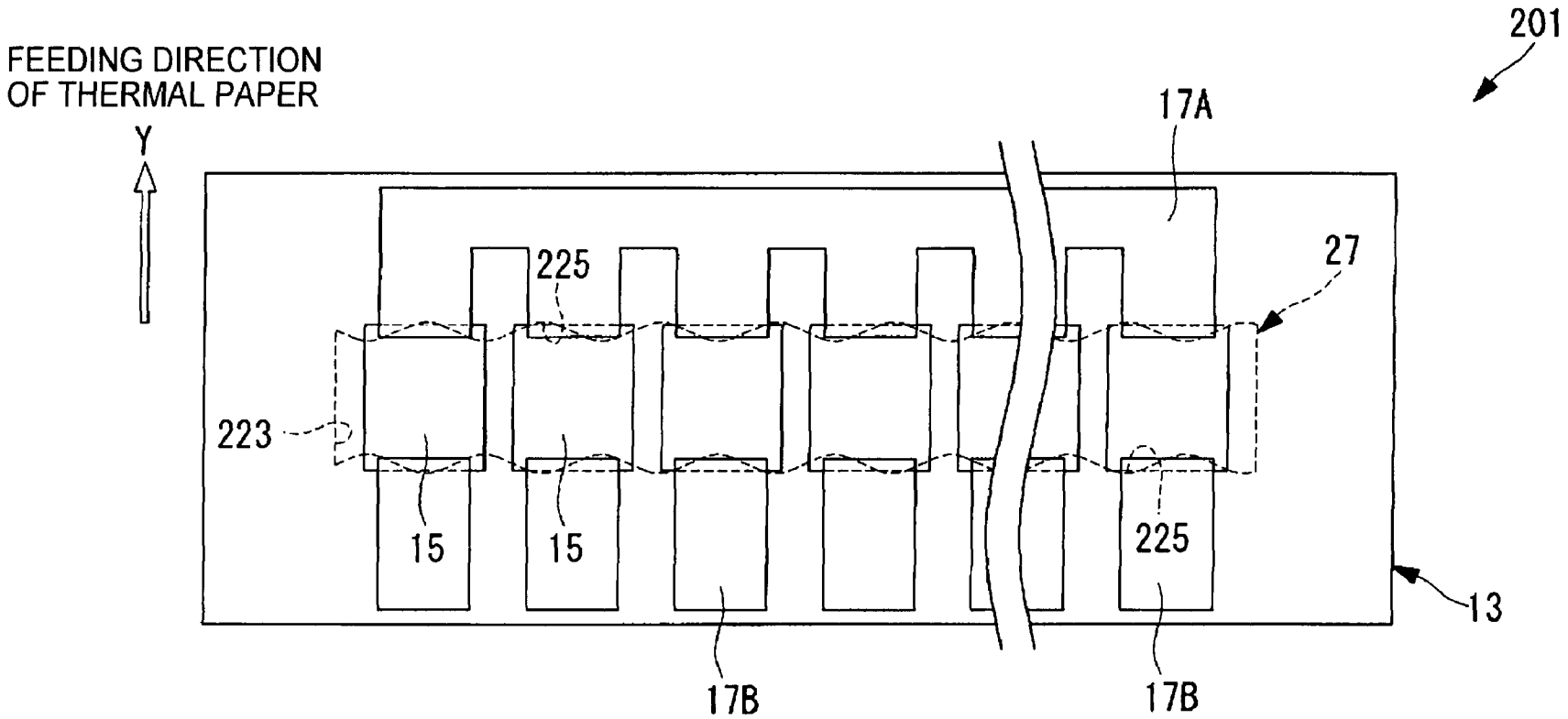
FIG. 11 is a plan view of a thermal head viewed from the protective film side according to a second modified example of the embodiment of the present invention.

According to a thermal head 201 according to a second modified example of the embodiment of the present invention, for example, as illustrated in FIG. 11, an inner wall extending in a longitudinal direction of a concave portion 223 may have a width dimension smaller than that of the heating regions of the heating resistors 15, and a groove 225 of the inner wall may have a width dimension exceeding the dimension of the heating resistor 15 in the longitudinal direction thereof.

With such a structure, the inner wall extending in the longitudinal direction of the concave portion 223 is positioned inside the heating regions of the heating resistors 15 to contribute to the increased mechanical strength of the upper substrate 12, while the bottom surface of the groove 225 of the inner wall is positioned outside the region opposed to the heating resistor 15 to contribute to the enhanced heat-insulating effect.

Figure 12:
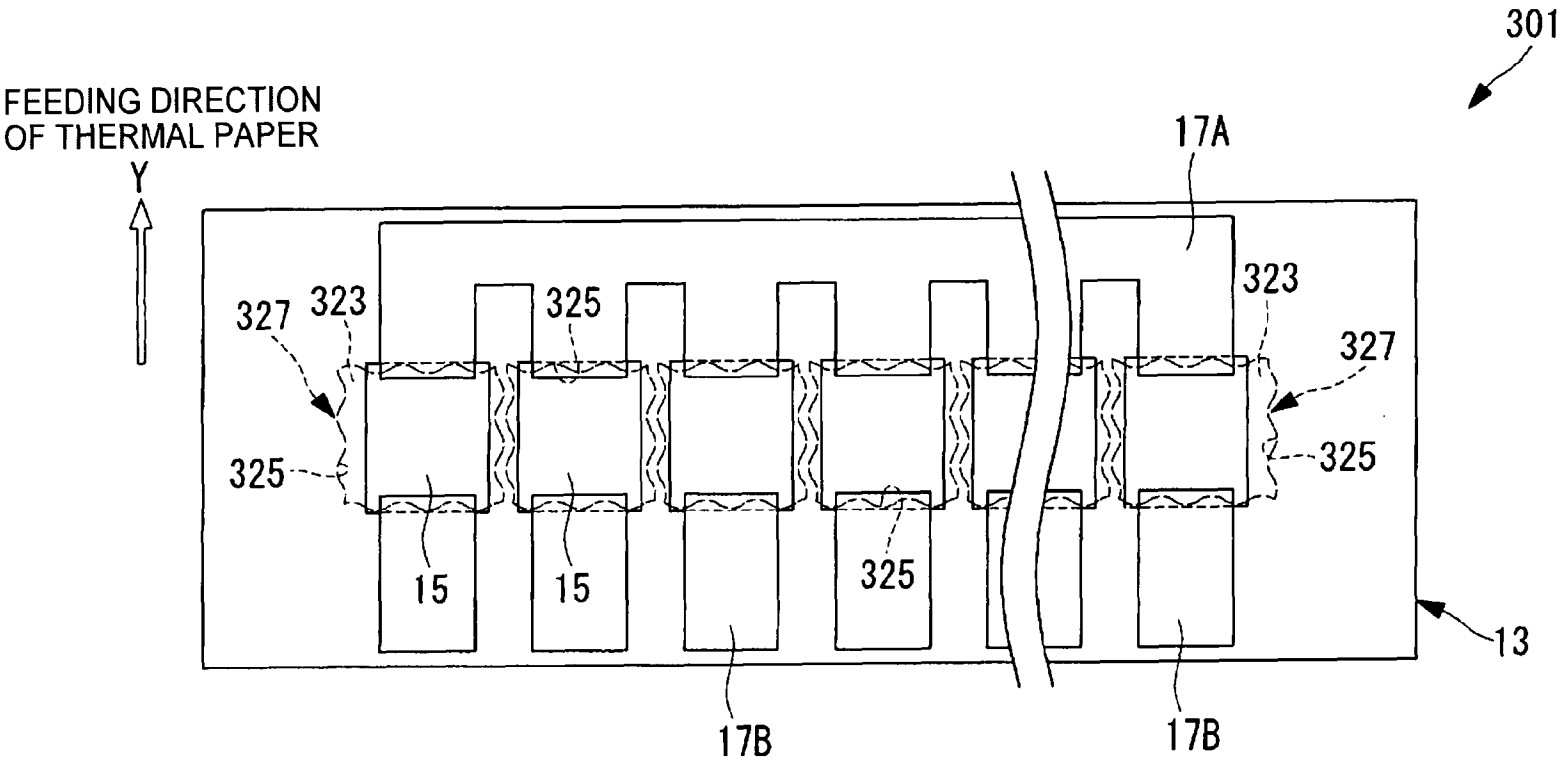
FIG. 12 is a plan view of a thermal head viewed from the protective film side according to a third modified example of the embodiment of the present invention.

Further, in the embodiment of the present invention, the cavity portion 27 has the communication structure opposed to all the heating resistors 15. However, according to a thermal head 301 of a third modified example of the embodiment of the present invention, for example, as illustrated in FIG. 12, a concave portion 323 may be formed in each region of the support substrate 14 opposed to the heating resistor 15 to provide an individual cavity portion 327 for each heating resistor 15.

With such a structure, the support substrate 14 supports the upper substrate 12 at short intervals to increase the mechanical strength of the upper substrate 12 supporting the heating resistors 15. In this case, grooves 325 may be formed in an entire inner wall, excluding the bottom surface, of a concave portion 323.

According to the above-mentioned embodiment and modified examples, the support substrate 14 has the concave portions 23, 123, 223, 323, respectively, but the upper substrate 12 may have a concave portion formed in a surface on the support substrate 14 side. Alternatively, both the support substrate 14 and the upper substrate 12 may have concave portions formed in bonding surfaces thereof.

Further, as the groove portion included in the inner wall of the concave portion, the above-mentioned embodiment and modified examples have exemplified the grooves 25, 125, 225, and 325, which are formed regularly in the inner walls of the concave portions 23, 123, 223, and 323, respectively. Alternatively, for example, the inner wall may have grooves formed therein irregularly, which are formed simultaneously with the formation of the concave portion by the etching process or the like.

What is claimed is:

1. A thermal head, comprising:

a substrate comprising a flat plate-shaped support substrate and a flat plate-shaped upper substrate which are bonded to each other in a stacked state; and a rectangular heating resistor formed on a surface of the flat plate-shaped upper substrate, wherein:

at least one of bonding surfaces of the flat plate-shaped support substrate and the flat plate-shaped upper substrate has a concave portion that forms a cavity portion in a region opposed to the rectangular heating resistor; and the concave portion has at least one groove portion formed in an inner wall thereof and recessed along a depth direction of the concave portion within a range of a width of the rectangular heating resistor.

2. A thermal head according to claim 1, wherein the inner wall including the at least one groove portion of the concave portion is positioned inside a heating region of the rectangular heating resistor.

3. A thermal head according to claim 1, wherein the inner wall including the at least one groove portion of the concave portion is positioned outside the region opposed to the rectangular heating resistor.

4. A thermal head according to claim 1, wherein the inner wall of the concave portion is positioned inside a heating region of the rectangular heating resistor, and wherein the at least one groove portion is positioned inside the region opposed to the rectangular heating resistor and outside the heating region of the rectangular heating resistor.

5. A thermal head according to claim 1, wherein the inner wall including the at least one groove portion of the concave portion is positioned inside the region opposed to the rectangular heating resistor and outside a heating region of the rectangular heating resistor.

6. A thermal head according to claim 1, wherein the inner wall of the concave portion is positioned inside a heating region of the rectangular heating resistor, and wherein the at least one groove portion is positioned outside the region opposed to the rectangular heating resistor.

7. A thermal head according to claim 1, wherein the at least one groove portion is recessed to depths varying in steps.

8. A thermal head according to claim 1, wherein the at least one groove portion forms the inner wall of the concave portion into a shape in which projections and depressions are alternately formed continuously.

9. A printer, comprising:

the thermal head according to claim 1; and a pressure mechanism for feeding a thermal recording medium while pressing the thermal recording medium against the rectangular heating resistor of the thermal head.

* * * * *